US010150330B1

(12) United States Patent
Pernici et al.

(10) Patent No.: US 10,150,330 B1
(45) Date of Patent: Dec. 11, 2018

(54) WRITING IMPLEMENT MOUNTING ASSEMBLIES AND METHODS

(71) Applicants: T. Scott Pernici, Shreveport, LA (US); Thomas P. Pernici, Shreveport, LA (US)

(72) Inventors: T. Scott Pernici, Shreveport, LA (US); Thomas P. Pernici, Shreveport, LA (US)

( * ) Notice: Subject to any disclaimer, the term of this patent is extended or adjusted under 35 U.S.C. 154(b) by 150 days.

(21) Appl. No.: 14/591,506

(22) Filed: Jan. 7, 2015

(51) Int. Cl.
*B43K 23/00* (2006.01)

(52) U.S. Cl.
CPC ..... *B43K 23/001* (2013.01)

(58) Field of Classification Search
CPC combination set(s) only.
See application file for complete search history.

(56) References Cited

U.S. PATENT DOCUMENTS 1,049,275 A 12/1912 Scott
1,262,972 A 4/1918 Olson
1,297,017 A 3/1919 Scott
1,607,097 A * 11/1926 Murphy ..... B43K 29/08 235/70 D
2,005,110 A 6/1935 Ritzert
2,964,812 A * 12/1960 Cook ..... B43K 25/024 239/DIG. 10
4,783,185 A * 11/1988 Erismann ..... B05C 17/002 401/118
5,829,903 A * 11/1998 Collins ..... B42D 9/004 281/30
5,863,072 A 1/1999 Sommer
6,056,468 A * 5/2000 Niewiadomski ..... B43K 29/02 401/195
6,135,661 A 10/2000 Houser
D708,264 S 7/2014 Roundy
9,211,757 B2 * 12/2015 Osborne ..... B43K 29/00

* cited by examiner

*Primary Examiner* — David Walczak
(74) *Attorney, Agent, or Firm* — R. Keith Harrison

(57) ABSTRACT

Writing implement mounting assemblies include a mounting tab having a tab insert end and a tab mount edge opposite the tab insert end. The mounting tab generally increases in thickness from the tab insert end to the tab mount edge. At least one writing implement is provided at the tab mount edge of the mounting tab. Writing implement mounting methods are also disclosed.

8 Claims, 10 Drawing Sheets

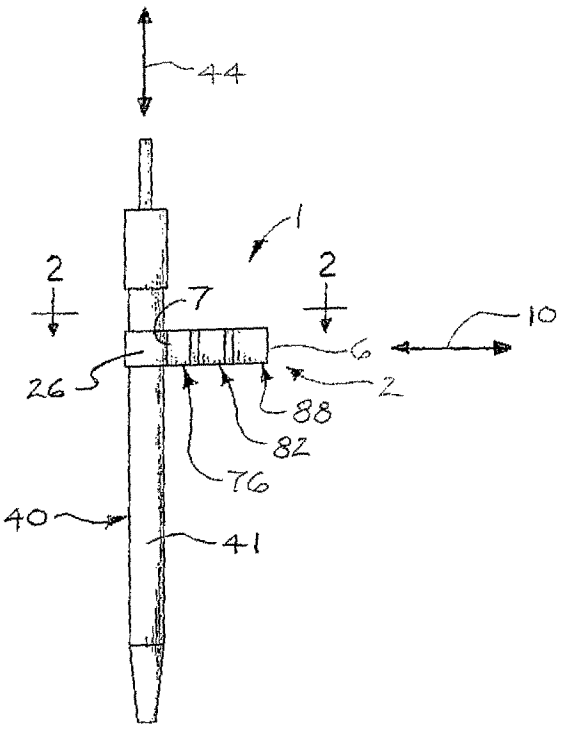
FIG. 1
FIG. 2
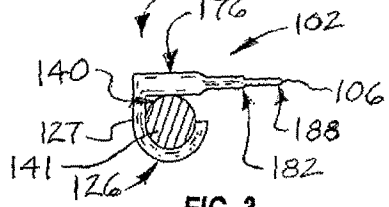
FIG. 3
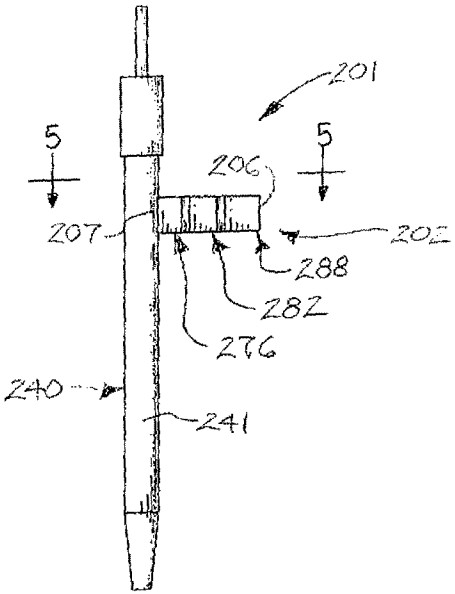
FIG. 4
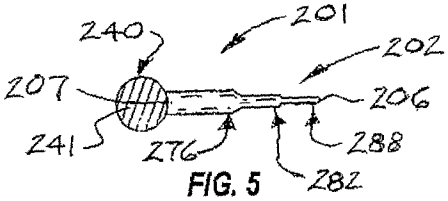
FIG. 5

WRITING IMPLEMENT MOUNTING ASSEMBLIES AND METHODS

FIELD

Illustrative embodiments of the disclosure generally relate to pens, pencils, markers, highlighters and other writing implements. More particularly, illustrative embodiments of the disclosure relate to writing implement mounting assemblies and methods which facilitate removable attachment of a writing implement to the interior of a vehicle in a location or position in which the writing implement is unobtrusive and yet readily accessible and retrievable for use by one or more occupants of the vehicle.

SUMMARY

Illustrative embodiments of the disclosure are generally directed to writing implement mounting assemblies. An illustrative embodiment of the writing implement mounting assemblies includes a mounting tab having a tab insert end and a tab mount edge opposite the tab insert end. In some embodiments, the mounting tab may generally increase in thickness from the tab insert end to the tab mount edge. At least one writing implement is provided at the tab mount edge of the mounting tab.

Illustrative embodiments of the disclosure are further generally directed to writing implement mounting methods. An illustrative embodiment of the writing implement mounting methods includes obtaining a writing implement mounting assembly having a writing implement and a mounting tab extending from the writing implement, locating a crevice on a vehicle interior for attachment of the writing implement mounting assembly to the vehicle interior and inserting the mounting tab of the writing implement mounting assembly in the crevice.

BRIEF DESCRIPTION OF THE DRAWINGS

Illustrative embodiments of the disclosure will now be described, by way of example, with reference to the accompanying drawings, in which:

FIG. 1 is a side view of an illustrative embodiment of the writing implement mounting assemblies, mounted on a writing implement;

FIG. 2 is a cross-sectional view, taken along section lines 2-2 in FIG. 1, of the writing implement with the illustrative writing implement mounting assembly mounted on the writing implement;

FIG. 3 is a cross-sectional view of a writing implement with an alternative illustrative writing implement mounting assembly mounted on the writing implement;

FIG. 4 is a side view of another alternative illustrative embodiment of the writing implement mounting assemblies mounted on a writing implement;

FIG. 5 is a cross-sectional view, taken along section lines 5-5 in FIG. 4, of the writing implement with the illustrative writing implement mounting assembly mounted on the writing implement;

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is non-limiting and is not necessarily to be construed as preferred or advantageous over other implementations. All of the implementations described below are exemplary implementation provided to enable a person skilled in the art to practice the disclosure and are not intended to limit the scope of the appended claims. Moreover, the illustrative embodiments described herein are not exhaustive and embodiments were implementations other than those which are described herein in which fall within the scope of the appended claims are possible. Furthermore, there is no intention to be bound by any expressed or implied theory presented in the preceding technical field, background, brief summary or the following detailed description.

Illustrative embodiments of the disclosure are generally directed to writing implement mounting assemblies which facilitate removable attachment of a writing implement to the interior of a vehicle in a location or position in which the writing implement is unobtrusive and yet readily accessible and retrievable for use by one or more occupants of the vehicle. The writing implement mounting assemblies may include a mounting tab having a tab insert end and a tab mount edge opposite the tab insert end. At least one writing implement is provided at the tab mount edge of the mounting tab. The mounting tab may generally increase in thickness from about 0.5 mm to about 2.75 mm from the tab insert end to the tab mount edge. The tab insert end of the mounting tab is adapted for insertion into a crevice in the vehicle interior to support the writing implement for access and use by one or more occupants of the vehicle. Accordingly, the writing implement mounting assemblies may be readily attached to the vehicle interior without modification to the vehicle interior.

Illustrative embodiments of the disclosure are further generally directed to writing implement mounting methods in which a writing implement is detachably attached to the interior of a vehicle in a location or position in which the writing implement is unobtrusive and yet readily accessible and retrievable for use by one or more occupants of the vehicle. The writing implement mounting methods may include obtaining a writing implement mounting assembly having a writing implement and a mounting tab extending from the writing implement, locating a crevice on a vehicle interior for attachment of the writing implement mounting assembly to the vehicle interior and inserting the mounting tab of the writing implement mounting assembly in the crevice.

Figure 6:
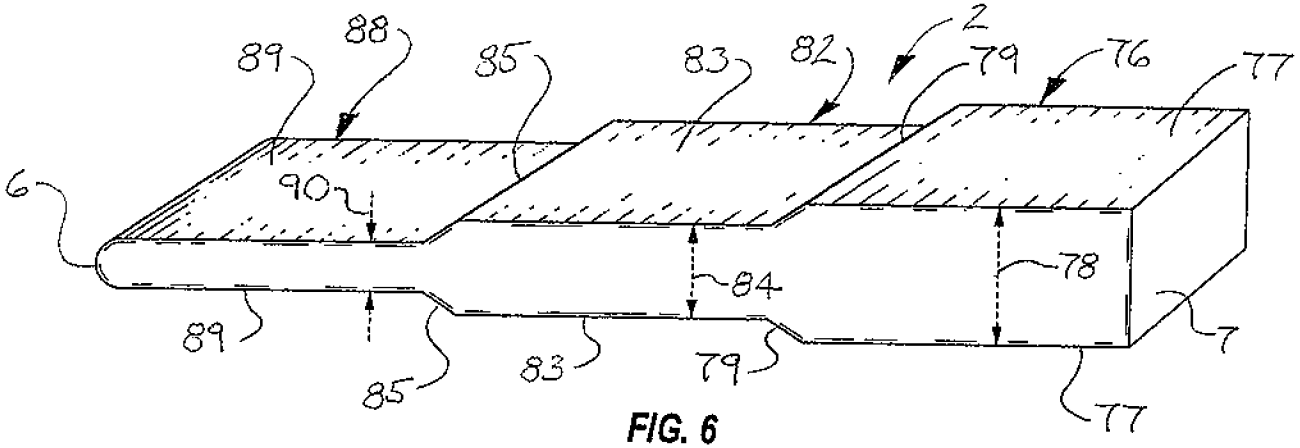
FIG. 6 is a side perspective view of a typical multi-tiered mounting tab having various thicknesses according to an illustrative embodiment of the writing implement mounting assemblies.

Referring initially to FIGS. 1, 2 and 6 of the drawings, an illustrative embodiment of the writing implement mounting assemblies, hereinafter assembly, is generally indicated by reference numeral 1. The assembly 1 is suitable to facilitate removable attachment of a writing implement 40 to the vehicle interior 60 (FIG. 7) of a vehicle in a location or position in which the writing implement 40 is unobtrusive and yet readily accessible and retrievable to one or more occupants of the vehicle, as will be hereinafter described. The vehicle interior 60 may include but is not limited to a vehicle dashboard, vehicle center console, vehicle ceiling, driver seat, passenger seat and interior of a vehicle door (not illustrated). The at least one writing implement 40 may include a pen, pencil, marker, highlighter and/or other writing implement which is to be mounted for ready access and retrieval for use by an occupant of the vehicle.

Figure 7:
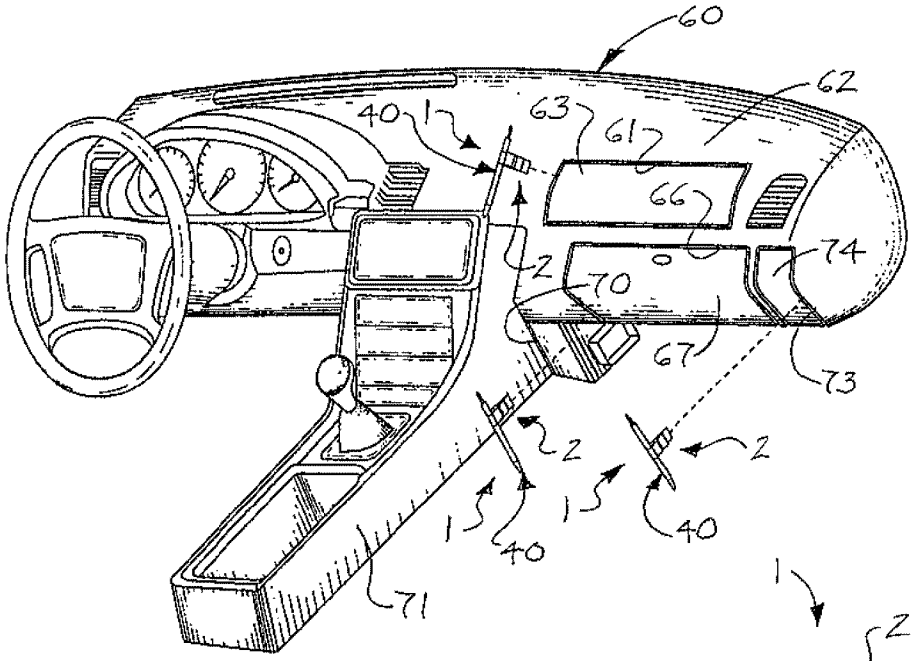
FIG. 7 is a perspective view of a vehicle interior, with multiple illustrative writing implement mounting assemblies shown detached from the vehicle interior in exploded view in typical engagement of the assemblies with crevices in the vehicle interior for attachment of writing implements to the vehicle interior.
Figure 8:
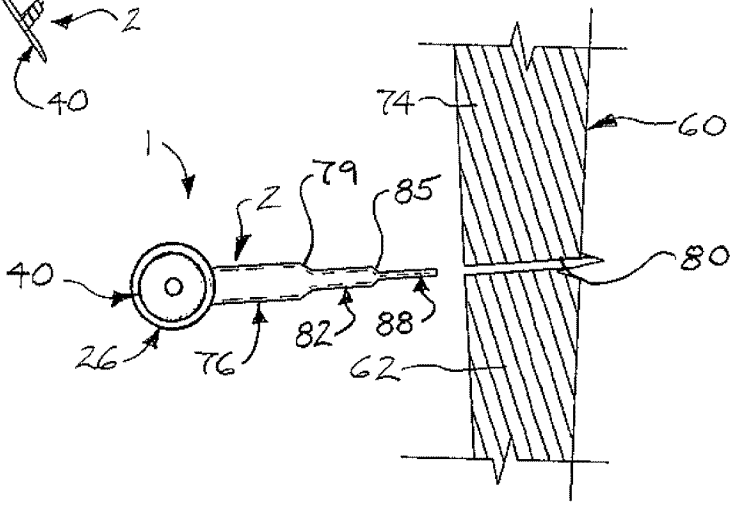
FIG. 8 is an enlarged cross-sectional view of a portion of the vehicle interior, more particularly illustrating insertion of the mounting tab of the illustrative writing implement mounting assembly in a crevice in the vehicle interior in attachment of the assembly to the vehicle interior according to typical application of the assembly.
Figure 12:
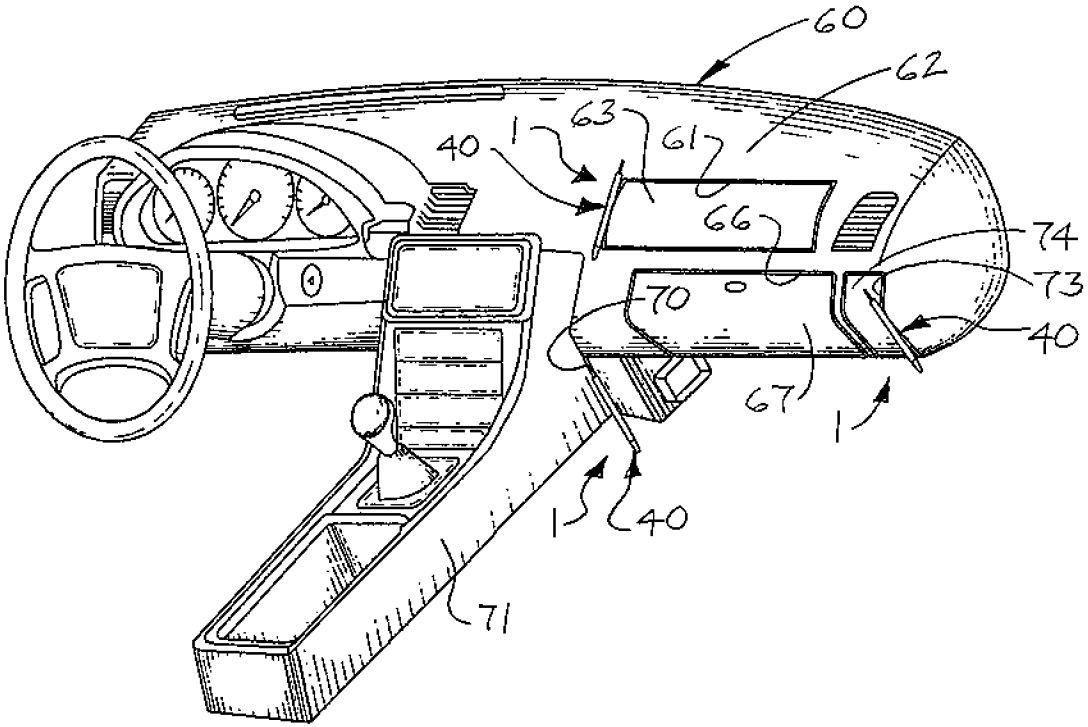
FIG. 12 is a perspective view of the vehicle interior, with the various writing implement mounting assemblies deployed in place for access, retrieval and use of the writing implements by one or more occupants of the vehicle.

The assembly 1 includes a mounting tab 2 which inserts into a crack, gap, joint, seam or crevice (hereinafter crevice, illustrated as reference numerals 61, 66, 70 and 73, respectively, in FIG. 7) between adjacent panels or components in a vehicle dashboard or other location or position in the vehicle interior 60 to mount the writing implement 40 in a selected visible and/or accessible and retrievable location or position within the vehicle interior 60. In the non-limiting example illustrated in FIGS. 7 and 12, a first crevice 61 extends between a main dashboard portion 62 and an airbag cover 63 in the vehicle interior 60. A second crevice 66 extends between the main dashboard portion 62 and a vehicle glove compartment door 67. A third crevice 70 extends between the main dashboard portion 62 and a vehicle center console 71. A fourth crevice 73 extends between the main dashboard portion 62 and a dashboard panel 74. However, in various applications of the assembly 1, the mounting tab 2 may be inserted into a crevice 80 (FIGS. 8-10) in the vehicle dashboard or other locations, positions, areas, compartments or components within the vehicle interior 60, including but not limited to the vehicle center console, vehicle ceiling, driver seat, passenger seat and interior of a vehicle door (not illustrated).

The mounting tab 2 of the assembly 1 may have a tab insert end 6 and a tab mount edge 7 opposite the tab insert end 6. As illustrated in FIG. 6, the mounting tab 2 of the assembly 1 may include a tab base 76. The tab base 76 has a tab base thickness 78. A tab middle segment 82 may extend from the tab base 76. The tab middle segment 82 has a middle segment thickness 84 which may be less than the tab base thickness 78 of the tab base 76. A tab insertion segment 88 may extend from the tab middle segment 82. The tab insertion segment 88 has an insertion segment thickness 90 which may be less than the middle segment thickness 84 of the tab middle segment 82. In alternative embodiments, the mounting tab 2 may be substantially uniform in thickness from the tab insert end 6 to the tab mount edge 7.

The tab base 76 of the mounting tab 2 may include a pair of opposite, generally planar, parallel tab base crevice engaging surfaces 77. The tab base thickness 78 of the tab base 76 may correspond to the distance between the tab base crevice engaging surfaces 77. In some embodiments, the tab base thickness 78 of the tab base 76 may range from about 2.25 mm to about 2.75 mm.

The tab middle segment 82 of the mounting tab 2 may have a pair of opposite, generally planar, parallel middle segment crevice engaging surfaces 83. A pair of beveled tab base transition surfaces 79 may angle from the tab base crevice engaging surfaces 77 of the tab base 76 to the respective middle segment crevice engaging surfaces 83 of the tab middle segment 82. The tab middle segment 82 may have a middle segment thickness 84 which corresponds to the distance between the middle segment crevice engaging surfaces 83. In some embodiments, the middle segment thickness 84 of the tab middle segment 82 may be about 0.8 mm.

The tab insertion segment 88 of the mounting tab 2 may include a pair of opposite, planar, parallel insertion segment crevice engaging surfaces 89. A pair of beveled middle segment transition surfaces 85 may angle from the middle segment crevice engaging surfaces 83 of the tab middle segment 82 to the respective insertion segment crevice engaging surfaces 89 of the tab insertion segment 88. The insertion segment thickness 90 of the tab insertion segment 88 may correspond to the distance between the insertion segment crevice engaging surfaces 89. In some embodiments, the insertion segment thickness 90 may be about 0.5 mm. The tab insertion segment 88 may have a tab insert end 6 which may be generally rounded cross-section, as further illustrated in FIG. 6.

As illustrated in FIGS. 1 and 2, at least one writing implement holder 26 may be provided at the tab mount edge 7 of the mounting tab 2. The mounting tab 2 and the writing implement holder 26 may include plastic, metal and/or any combination of materials which are suitable for the purpose. In some embodiments, the writing implement holder 26 may be fabricated in one piece with the mounting tab 2 using casting, molding or other fabrication techniques known by those skilled in the art. In other embodiments, the writing implement holder 26 may be fabricated separately and attached to the mounting tab 2 according to the knowledge of those skilled in the art.

The writing implement holder 26 may include any type of mechanism or device which is capable of receiving and holding or supporting at least one writing implement 40. In some embodiments, the writing implement holder 26 may include a writing implement collar having a writing implement collar opening 28 (FIG. 2) which is sized and configured to accommodate and hold an elongated writing implement shaft 41 of the writing implement 40. Accordingly, as illustrated in FIG. 1, the mounting tab 2 may have a longitudinal mounting tab axis 10 which is generally perpendicular to a longitudinal writing implement axis 44 of the writing implement 40. In some embodiments, the writing implement holder 26 may be fixedly attached to the writing implement shaft 41 using glue, fasteners and/or other suitable attachment technique known by those skilled in the art. In other embodiments, the writing implement holder 26 may be detachably attached to the writing implement shaft 41 in a friction fit.

Figure 9:
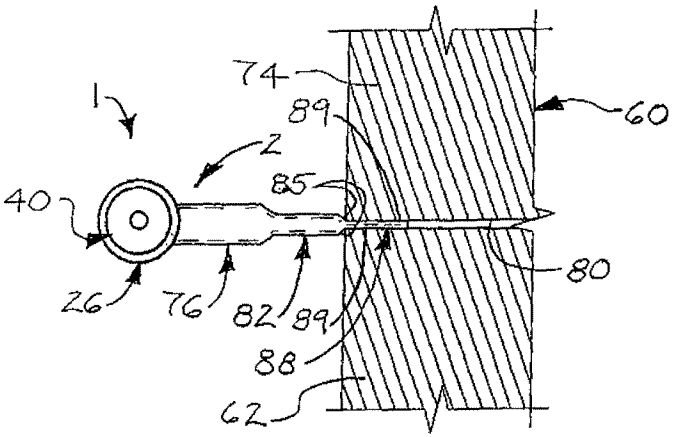
FIG. 9 is a sectional view of a portion of the vehicle interior, with an illustrative writing implement mounting assembly (illustrated in top view) having the multi-tiered mounting tab illustrated in FIG. 6 attached to the vehicle interior, more particularly illustrating insertion of a terminal tab insertion segment of the multi-tiered mounting tab of the assembly into a narrow crevice in the vehicle interior in typical application of the assembly.

As illustrated in FIGS. 7-12, the assembly 1 may be attached to the vehicle interior 60 by inserting the mounting tab 2 into a crevice 80 in the dashboard or other selected location or position within the vehicle interior 60. Accordingly, the tab base thickness 78, the middle segment thickness 84 and the insertion segment thickness 90 (FIG. 6) of the respective tab base 76, tab middle segment 82 and tab insertion segment 88 accommodate the various widths of different crevices 80 in the vehicle interior 60. As illustrated in FIG. 9, under circumstances in which the crevice 80 is about 0.5 mm in width, the tab insertion segment 88 of the mounting tab 2 may be inserted into the crevice 80 with the crevice engaging surfaces 89 (FIG. 6) on the tab insertion segment 88 engaging the respective interior surfaces of the crevice 80. The beveled middle segment transition surfaces 85 on the tab middle segment 82 may engage the vehicle interior 60 as the tab middle segment 82 and the tab base 76 typically remain outside the crevice 80. Thus, the insertion segment thickness 90 (FIG. 6) of the tab insertion segment 88 is sufficient to facilitate snug engagement of the insertion segment crevice engaging surfaces 89 with the respective interior surfaces of the crevice 80 and securely and yet detachably attach or mount the assembly 1 on the vehicle interior 60.

Figure 10:
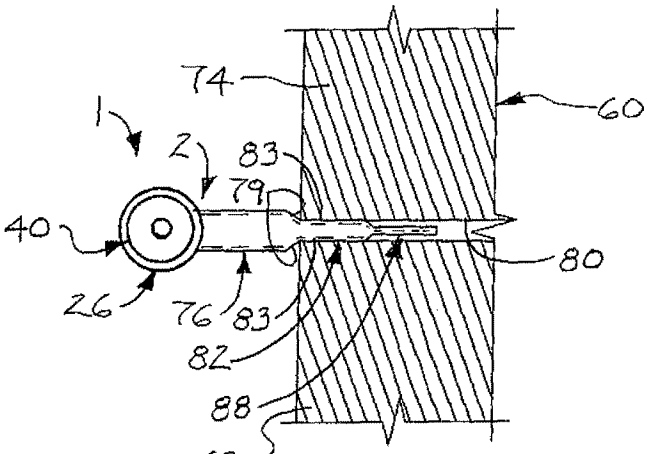
FIG. 10 is a sectional view of a portion of the vehicle interior, with an illustrative writing implement mounting assembly (illustrated in top view) having the multi-tiered mounting tab illustrated in FIG. 6 attached to the vehicle interior, more particularly illustrating insertion of a terminal tab insertion segment and a tab middle segment of the multi-tiered mounting tab of the assembly into a crevice of intermediate width in the vehicle interior in typical application of the assembly.

As illustrated in FIG. 10, under circumstances in which the crevice 80 has a width of about 0.8 mm, both the tab insertion segment 88 and the tab middle segment 82 may be inserted into the crevice 80 with the middle segment crevice engaging surfaces 83 (FIG. 6) on the tab middle segment 82 engaging the respective interior surfaces of the crevice 80. The tab base transition surfaces 79 may engage the vehicle interior 60 as the tab base 76 typically remains outside the crevice 80.

Figure 11:
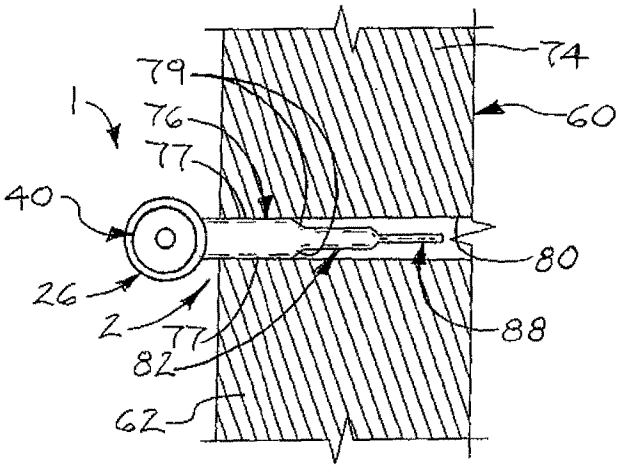
FIG. 11 is a sectional view of a portion of the vehicle interior, with an illustrative writing implement mounting assembly (illustrated in top view) having the multi-tiered mounting tab illustrated in FIG. 6 attached to the vehicle interior, more particularly illustrating insertion of a terminal tab insertion segment, a tab middle segment and a tab base of the multi-tiered mounting tab of the assembly into a wide crevice in the vehicle interior in typical application of the assembly.

As illustrated in FIG. 11, under circumstances in which the crevice 80 has a width of typically from about 0.25 mm to about 2.75 mm, the tab insertion segment 88, the tab middle segment 82 and the tab base 76 may be inserted into the crevice 80. The tab base crevice engaging surfaces 77 on the tab base 76 engage the respective interior surfaces of the crevice 80. In the foregoing manner, the tab base 76, the tab middle segment 82 and the tab insertion segment 88 facilitate a snug or tight fit of the mounting tab 2 in the crevice 80 irrespective of the various widths of crevices 80 at different locations or positions within the vehicle interior 60.

Referring again to FIGS. 7-12 of the drawings, in typical application of the assembly 1, the writing implement 40 can be mounted in a selected location or position in the vehicle interior 60 to render the writing implement 40 unobtrusive and yet easily accessible and retrievable for use by an occupant of the vehicle. As was heretofore described with respect to FIGS. 8-11, depending upon the width of the crevice 80, the mounting tab 2 may be inserted in the crevice 80 to an extent that the tab insertion segment 88 (FIG. 9), the tab middle segment 82 (FIG. 10) or the tab base 76 (FIG. 11) engages the interior surfaces of the crevice 80 to secure or wedge the mounting tab 2 within the crevice 80. The writing implement 40 and the assembly 1 can be easily removed or detached from the vehicle interior 60 for use by an occupant of the vehicle by pulling the mounting tab 2 from the crevice 80. The writing implement 40 can be replaced at the same or a different location along the crevice 80 or at a different crevice 80 within the vehicle interior 60 depending on the desired accessibility of the writing implement 40 within the vehicle interior 60.

Referring next to FIG. 3 of the drawings, an alternative illustrative embodiment of the writing implement mounting assemblies is generally indicated by reference numeral 101. In the assembly 101, elements which are analogous to the respective elements of the assembly 1 that was heretofore described with respect to FIGS. 1 and 2 are designated by the same numerals in the 101-199 series in FIG. 3. Unless otherwise noted, the elements and features of the assembly 101 may encompass the same descriptions which were heretofore applied to the assembly 1. The writing implement holder 126 of the assembly 101 may include a generally curved or semicircular writing implement clip 127. The tab base 176 of the mounting tab 102 may extend from the writing implement clip 127. Accordingly, the writing implement 140 may be detachably secured in the writing implement clip 127 of the writing implement holder 126 in a snap-fit. Application of the assembly 101 may be as was heretofore described with respect to the assembly 1 in FIGS. 7-12.

Referring next to FIGS. 4 and 5 of the drawings, another alternative illustrative embodiment of the writing implement mounting assemblies is generally indicated by reference numeral 201. In the assembly 201, elements which are analogous to the respective elements of the assembly 1 that was heretofore described with respect to FIGS. 1 and 2 are designated by the same numerals in the 201-299 series in FIGS. 4 and 5. Unless otherwise noted, the elements and features of the assembly 201 may encompass the same descriptions which were heretofore applied to the assembly 1. The mounting tab 202 of the assembly 201 may protrude from the writing implement shaft 241 of the writing implement 240. Accordingly, in some embodiments, the tab mount edge 207 of the mounting tab 202 may be fabricated in one piece with the writing implement shaft 241 of the writing implement 240 using casting, molding or other suitable fabrication technique known by those skilled in the art. In other embodiments, the mounting tab 202 and the writing implement 240 may be fabricated separately. The tab mount edge 207 may be attached to the writing implement shaft 241 using glue and/or by inserting and securing the tab mount edge 207 in a companion tab slot (not illustrated) provided in the writing implement shaft 241 for the purpose. Application of the assembly 201 may be as was heretofore described with respect to the assembly 1 in FIGS. 7-12.

Figure 13:
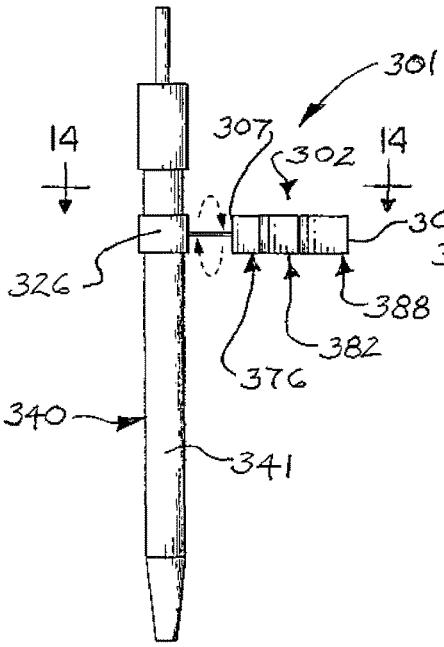
FIG. 13 is a side view of an alternative illustrative embodiment of the writing implement mounting assemblies.
Figure 14:
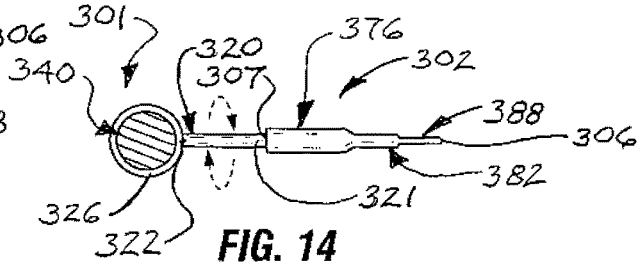
FIG. 14 is a cross-sectional view of a writing implement, taken along section lines 14-14 in FIG. 13, with the illustrative writing implement mounting assembly mounted on the writing implement.

Referring next to FIGS. 13 and 14 of the drawings, still another alternative illustrative embodiment of the writing implement mounting assemblies is generally indicated by reference numeral 301. In the assembly 301, elements which are analogous to the respective elements of the assembly 1 that was heretofore described with respect to FIGS. 1 and 2 are designated by the same numerals in the 301-399 series in FIGS. 13 and 14. Unless otherwise noted, the elements and features of the assembly 301 may encompass the same descriptions which were heretofore applied to the assembly 1. A multi-positional or universally manipulatable writing implement holder stem 320 may extend from the mounting tab 302. The writing implement holder 326 is supported by and may be attached to the article stem 320 according to any suitable technique which is known by those skilled in the art. As will be hereinafter described, the writing implement holder stem 320 can be selectively bended, rotated, twisted and/or otherwise universally spatially manipulated into a desired two-dimensional or three-dimensional position or configuration to support or hold the writing implement holder 326 and the writing implement 340 on the vehicle interior 60 (FIGS. 7 and 12) in a desired orientation for retrieval and use by one or more occupants of the vehicle.

The writing implement holder stem 320 of the assembly 301 may include any bendable, pliable or workable metal or material which holds its position upon being spatially bended, twisted and/or otherwise manipulated and then released. Non-limiting examples of materials which are suitable for the writing implement holder stem 320 include steel, lead, copper, aluminum and combinations thereof. The writing implement holder stem 320 may have a flat, round or other cross-section which may be constant or variable along its length. As illustrated in FIG. 14, the writing implement holder stem 320 may include a proximal stem end 321 which is attached to the tab mount edge 307 of the mounting tab 302 and a distal stem end 322 which is opposite the proximal stem end 321. As used herein, "proximal" means closer to the mounting tab 302 and "distal" means farther from the mounting tab 302.

The writing implement holder 326 may be attached to the distal stem end 322 of the writing implement holder stem 320 using any suitable attachment technique which is known by those skilled in the art. For example and without limitation, in some embodiments, the writing implement holder 326 may be attached to the distal stem end 322 of the writing implement holder stem 320 using glue, adhesive, magnetic attachment mechanism or the like. In other embodiments, the distal stem end 322 may be threaded or inserted into or embedded within the writing implement holder 326. To this end, in some embodiments the distal stem end 322 portion of the writing implement holder stem 320 may be shaped, looped, coiled or bent to provide an enlarged surface area on which to securely mount the writing implement holder 326 to the writing implement holder stem 320. In still other embodiments, the distal stem end 322 may be molded, laminated or otherwise fabricated integrally with the writing implement holder 326 according to the knowledge of those skilled in the art.

Application of the assembly 301 may be as was heretofore described with respect to the assembly 1 in FIGS. 7-12. The writing implement holder stem 320 can be rotated, bended, twisted and/or otherwise physically manipulated to orient the writing implement holder 326 and the writing implement 340 at a selected two-dimensional or three-dimensional spatial orientation relative to the mounting tab 302 in order to optimize the accessibility of the writing implement 340 for retrieval from the vehicle interior 60 and use by an occupant of the vehicle in an unobtrusive manner. For example and without limitation, the writing implement holder stem 320 can be physically manipulated to form one or more 90-degree bends and/or one or more twists to selectively orient the writing implement 340 at the desired orientation. An obtuse angle bend or a gradual bend can be induced in the writing implement holder stem 320 depending upon the desired orientation of the writing implement 340 with respect to the mounting tab 302 and the vehicle interior 60.

Referring next to FIGS. 15, 16, 20 and 21 of the drawings, yet another alternative illustrative embodiment of the writing implement mounting assemblies is generally indicated by reference numeral 401. In the assembly 401, elements which are analogous to the respective elements of the assembly 301 that was heretofore described with respect to FIGS. 13 and 14 are designated by the same numerals in the 401-499 series in FIGS. 15 and 16. Unless otherwise noted, the elements and features of the assembly 401 may encompass the same descriptions which were heretofore applied to the assembly 301. The mounting tab 402 of the assembly 401 may include a generally flat or planar tab panel 403 which may be generally elongated and rectangular in some embodiments. The tab panel 403 may be fabricated of paper, plastic, rubber, metal and/or other rigid or semi-rigid material which facilitates insertion of the tab panel 3 into a crevice 80 (FIGS. 8-11) between adjacent panels or components in a vehicle dashboard or other location or position in the vehicle interior 60 to mount the writing implement 440 in a selected unobtrusive, accessible and retrievable location or position within the vehicle interior 60.

In some embodiments, the tab panel 403 of the mounting tab 402 may be generally elongated with a first panel surface 404, a second panel surface 405, a tab insert end 406, an article mount edge 407 and a pair of tab side edges 408 which extend between the tab insert end 406 and the article mount edge 407. The tab side edges 408 may be generally parallel to each other. Alternatively, the tab side edges 408 may gradually taper toward each other from the article mount edge 407 to the tab insert end 406. Thus, the tab insert end 406 may be rounded or pointed in some embodiments.

Figure 16:
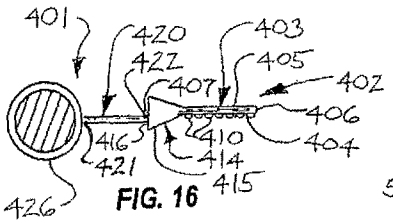
FIG. 16 is a cross-sectional view, taken along section lines 16-16 in FIG. 15, of the writing implement with the illustrative writing implement mounting assembly mounted on the writing implement.

In some embodiments, a tab head 414 may protrude from at least one of the first panel surface 404 and the second panel surface 405 of the tab panel 403. In some embodiments, the tab head 414 may be molded and/or otherwise fabricated integrally with the tab panel 403 of the mounting tab 402. In other embodiments, the tab head 414 may be applied to the tab panel 403 according to the knowledge of those skilled in the art. As illustrated in FIG. 16, the tab head 414 may be generally wedge-shaped in side view or cross-section with a mount surface 416 which may be generally flush or even with the article mount edge 407 of the tab panel 403. At least one beveled vehicle interior engaging surface 415 may slope or angle from the mount surface 416 toward the tab insert end 406 and terminate at the first panel surface 404 and/or the second panel surface 405 of the tab panel 403. The tab head 414 may gradually increase the width of the mounting tab 402 to facilitate secure insertion of the mounting tab 402 into crevices 80 having a wide variety of widths and increase the number of possible locations or positions which a user can select to mount the assembly 401 within the vehicle interior 60, as will be hereinafter described. In some embodiments, multiple tab ridges 410 may protrude from at least one of the first panel surface 404 and the second panel surface 405 between the vehicle interior engaging surface 415 of the tab head 414 and the tab insert end 406 of the tab panel 403 in a selected number and pattern.

Figure 20:
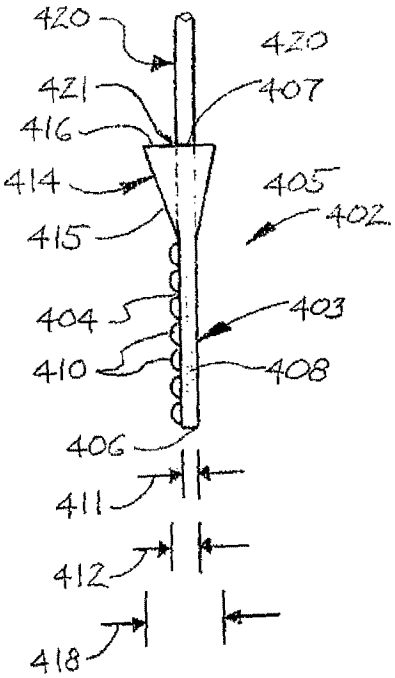
FIG. 20 is an enlarged side view of a typical mounting tab of the illustrative writing implement mounting assemblies illustrated in FIG. 15-19, more particularly illustrating various thicknesses for different lengths or portions of the mounting tab.

As illustrated in FIG. 20, the tab panel 403 of the mounting tab 402 may have a tab panel thickness 411. The tab panel 403 and each of the tab ridges 410 together may have a combined tab ridge thickness 412. The tab panel 403 and the tab head 414 may together have a combined tab head thickness 418. In some embodiments, the tab panel thickness 411 of the mounting tab 402 may be at least about 0.5 mm. The tab ridge thickness 412 may be at least about 0.7 mm. The tab head thickness 418 may range from about 0.8 mm to about 2.75 mm. Accordingly, in attachment of the assemblies 401 to the vehicle interior 60, which will be hereinafter described, the mounting tab 402 is configured to insert into selected crevices 80 (FIGS. 7-12) having different widths in the vehicle interior 60 to tightly engage the interior surfaces of the crevices and securely support the assemblies 401 at the selected positions or locations on the vehicle interior 60.

Figure 21:
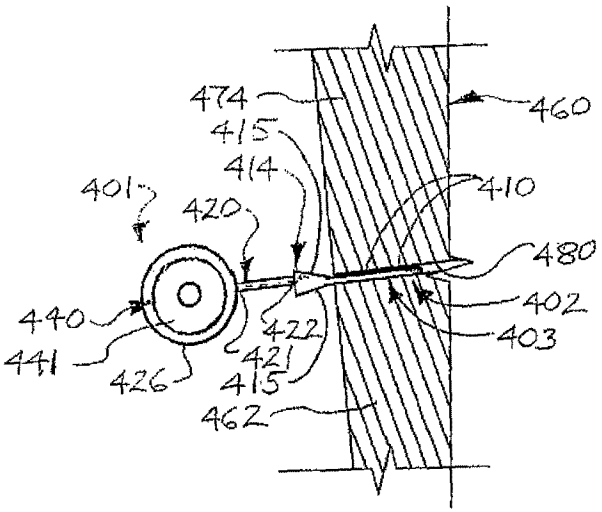
FIG. 21 is an enlarged cross-sectional view of a portion of the vehicle interior, with the mounting tab of the illustrative writing implement mounting assembly of FIGS. 15 and 16 illustrated in top view and inserted in a crevice in the vehicle interior in attachment of the assembly to the vehicle interior according to typical application of the assembly.

Application of the assembly 401 may be as was heretofore described with respect to the assembly 301 in FIGS. 13 and 14. The writing implement holder stem 420 may be rotated, bended, twisted and/or otherwise physically manipulated to spatially orient the writing implement holder 426 and writing implement 440 in such a manner that the writing implement 440 is oriented in a position or location which renders the writing implement 440 unobtrusive and yet accessible to occupants of the vehicle when the mounting tab 402 of the assembly 401 is inserted in the crevice 480. Accordingly, after the writing implement holder stem 420 is suitably manipulated, the mounting tab 402 may be inserted in the crevice 480. Alternatively, the writing implement holder stem 420 may be manipulated after the mounting tab 402 is inserted in the crevice 480. As illustrated in FIG. 21, the tab ridges 410 on the tab panel 403 of the mounting tab 402 may frictionally engage one of the interior surfaces of the crevice 480 to stabilize the mounting tab 402 within the crevice 480. In some applications, depending on the width of the crevice 480, the mounting tab 402 may be inserted in the crevice 480 to an extent that the beveled vehicle interior engaging surface or surfaces 415 on the tab head 414 engage(s) the interior surface of the crevice 480 to secure or wedge the mounting tab 402 within the crevice 480. As further illustrated in FIG. 21, the writing implement 440 may be oriented in generally parallel relationship to the plane of the vehicle interior 460 such that the writing implement 440 is unobtrusive and easily accessible to an occupant of the vehicle. The assembly 401 and writing implement 440 can be easily removed or detached from the vehicle interior 460, as desired, by pulling the mounting tab 402 from the crevice 480.

Figure 15:
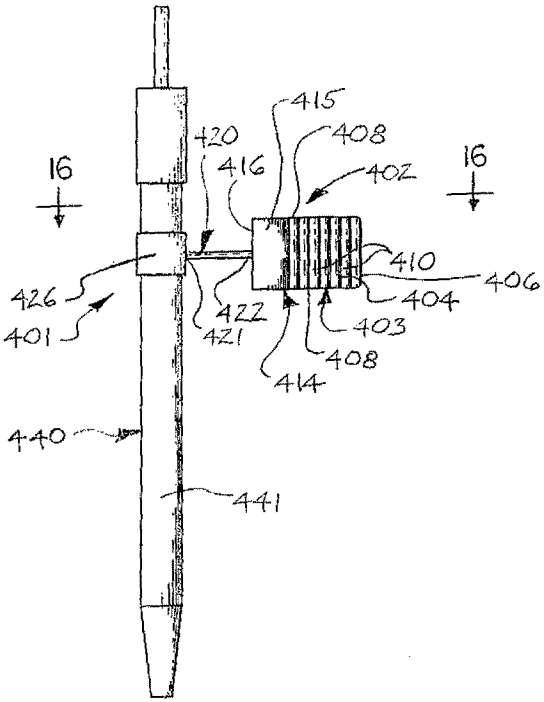
FIG. 15 is a side view of an alternative illustrative embodiment of the writing implement mounting assemblies, mounted on a writing implement.
Figure 22:
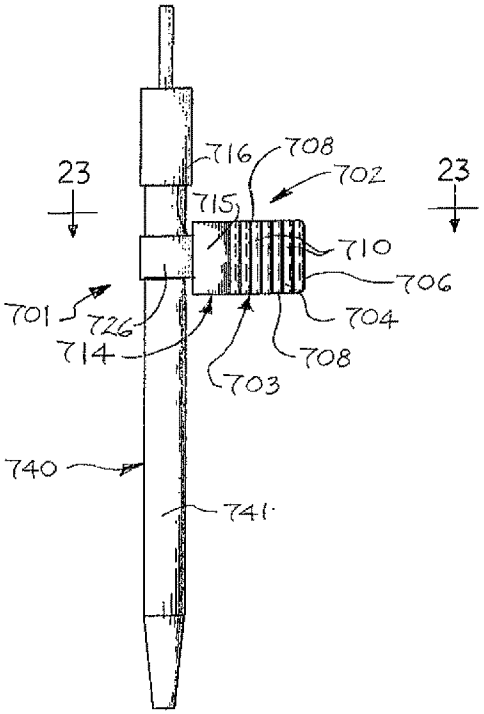
FIG. 22 is a side view of another alternative illustrative embodiment of the writing implement mounting assemblies, mounted on a writing implement.
Figure 23:
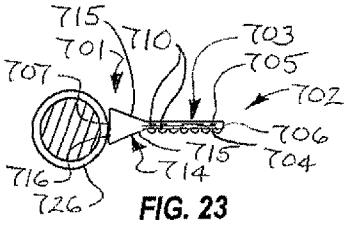
FIG. 23 is a cross-sectional view, taken along section lines 23-23 in FIG. 22, of the writing implement with the illustrative writing implement mounting assembly mounted on the writing implement.

Referring next to FIGS. 22 and 23 of the drawings, yet another alternative illustrative embodiment of the writing implement mounting assemblies is generally indicated by reference numeral 701. In the assembly 701, elements which are analogous to the respective elements of the assembly 401 that was heretofore described with respect to FIGS. 15 and 16 are designated by the same numerals in the 701-799 series in FIGS. 22 and 23. Unless otherwise noted, the elements and features of the assembly 701 may encompass the same descriptions which were heretofore applied to the assembly 401. Accordingly, the writing implement holder stem 420 (FIG. 15) may be omitted and the tab panel 703 of the mounting tab 702 may extend directly from the writing implement holder 726. The tab mount edge 707 (FIG. 23) of the tab panel 703 may be attached to the writing implement holder 726 according to the knowledge of those skilled in the art. In some embodiments, the tab panel 703 may be fabricated in one piece with the writing implement holder 726 using molding and/or other suitable fabrication techniques known by those skilled in the art. Application of the assembly 701 may be as was heretofore described with respect to the assembly 401 in FIGS. 15, 16 and 21, except the writing implement holder 726 and the writing implement 740 may be disposed in fixed spatial relationship to the mounting tab 402.

Figure 17:
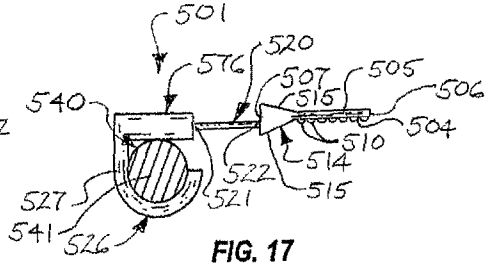
FIG. 17 is a cross-sectional view of a writing implement with an alternative illustrative writing implement mounting assembly mounted on the writing implement.
Figure 24:
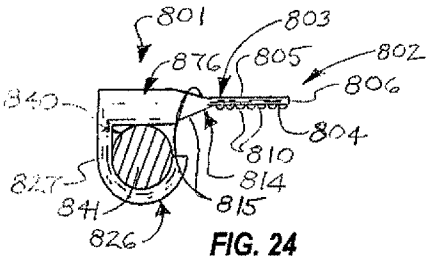
FIG. 24 is a cross-sectional view of a writing implement with an alternative illustrative writing implement mounting assembly mounted on the writing implement.

Referring next to FIG. 24 of the drawings, another alternative illustrative embodiment of the writing implement mounting assemblies is generally indicated by reference numeral 801. The assembly 801 may have the same design and components as those of the writing implement mounting assembly 501 illustrated in FIG. 17, except the writing implement holder stem 520 (FIG. 17) may be omitted. Application of the assembly 801 may be as was heretofore described with respect to the assembly 401 in FIGS. 15, 16 and 21, except the writing implement holder 826 and the writing implement 840 may be disposed in fixed spatial relationship to the mounting tab 802.

Figure 18:
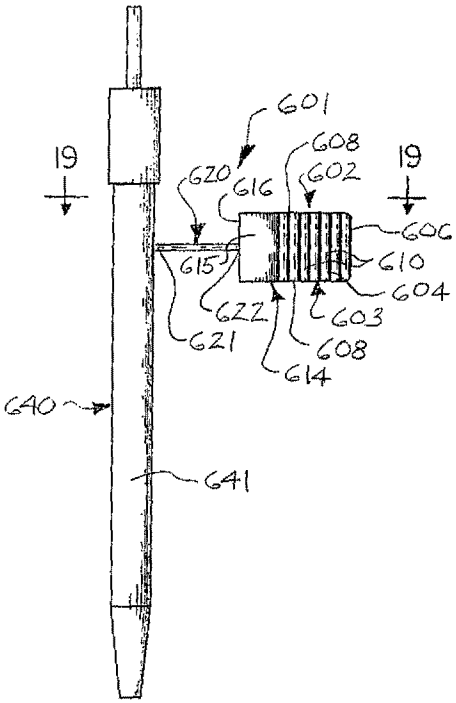
FIG. 18 is a side view of another alternative illustrative embodiment of the writing implement mounting assemblies mounted on a writing implement.
Figure 19:
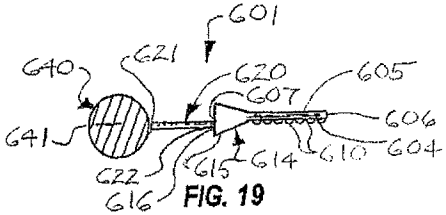
FIG. 19 is a cross-sectional view, taken along section lines 19-19 in FIG. 18, of the writing implement with the illustrative writing implement mounting assembly mounted on the writing implement.
Figure 25:
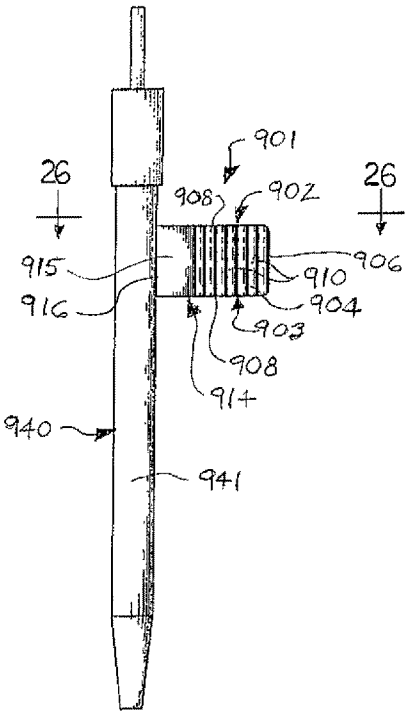
FIG. 25 is a side view of another alternative illustrative embodiment of the writing implement mounting assemblies mounted on a writing implement.
Figure 26:
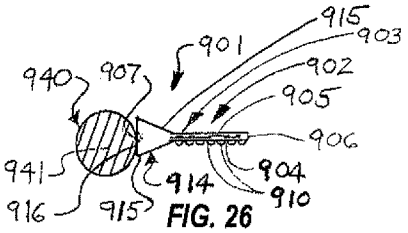
FIG. 26 is a cross-sectional view, taken along section lines 26-26 in FIG. 25, of the writing implement with the illustrative writing implement mounting assembly mounted on the writing implement.

Referring next to FIGS. 25 and 26 of the drawings, another alternative illustrative embodiment of the writing implement mounting assemblies is generally indicated by reference numeral 901. The assembly 901 may have the same design and components as those of the writing implement mounting assembly 601 which was heretofore described with respect to FIGS. 18 and 19, except the writing implement holder stem 620 (FIG. 18) may be omitted. Accordingly, the tab mount edge 907 (FIG. 26) of the tab panel 903 may be attached to the writing implement shaft 941 of the writing implement 940 according to the knowledge of those skilled in the art. In some embodiments, the tab panel 903 may be fabricated in one piece with the writing implement 940 using molding and/or other fabrication techniques known by those skilled in the art. In other embodiments, the tab panel 903 may be inserted and secured in a companion tab panel slot (not illustrated) in the writing implement shaft 941 according to the knowledge of those skilled in the art. In application of the assembly 901, the writing implement 940 may be disposed in fixed spatial relationship to the mounting tab 902.

Figure 27:
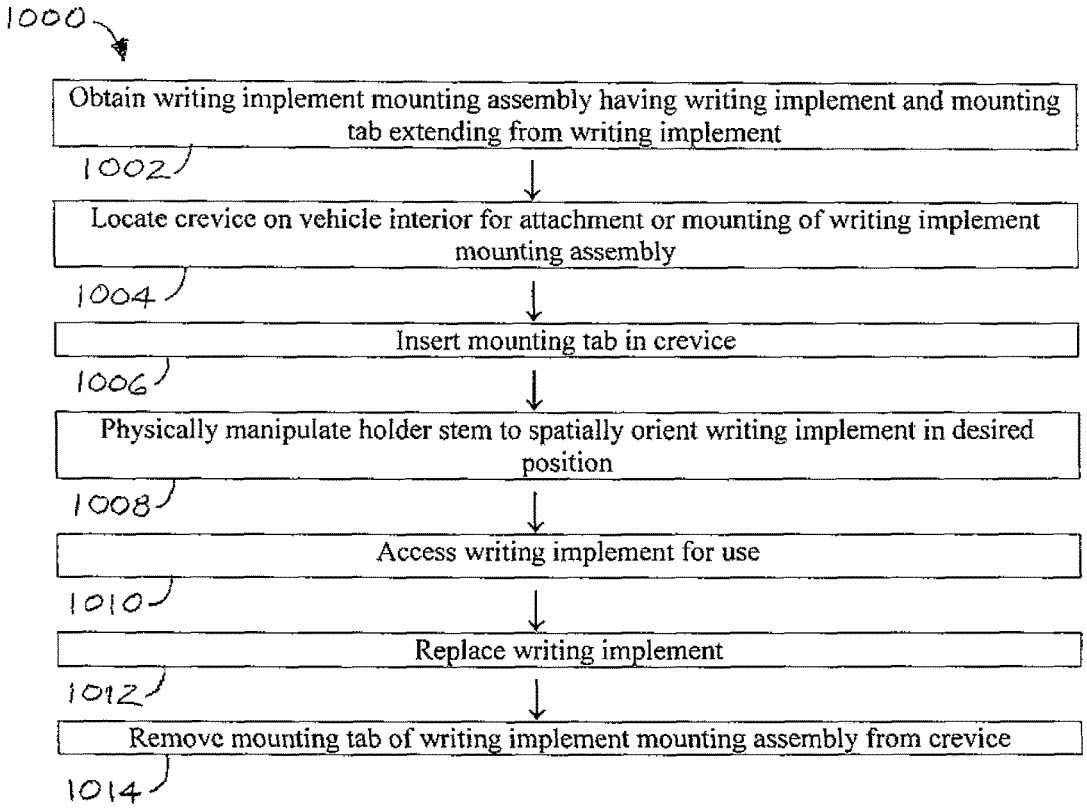
FIG. 27 is a flow diagram of an illustrative embodiment of the writing implement mounting methods.

Referring next to FIG. 27 of the drawings, a flow diagram of an illustrative embodiment of the writing implement mounting methods is generally indicated by reference numeral 1000. At block 1002, a writing implement mounting assembly is obtained. In various embodiments of the methods, the elements and features of the writing implement mounting assembly may encompass the same descriptions which were heretofore applied to the various illustrative embodiments of the writing implement mounting assemblies which were heretofore described with respect to FIGS. 1-26 of the drawings. The writing implement mounting assembly may include a writing implement and a mounting tab which extends from the writing implement. In some embodiments, the writing implement mounting assembly may include a mounting tab, at least one writing implement holder on the mounting tab and a writing implement supported by the writing implement holder. In some embodiments, a universally manipulatable writing implement holder stem may extend from the mounting tab. The writing implement holder or the writing implement may be supported by the writing implement holder stem.

At block 1004, a crevice on the vehicle interior which is suitable for attachment or mounting of the writing implement mounting assembly is located. At block 1006, the mounting tab of the writing implement mounting assembly is inserted in the crevice. At block 1008, in some embodiments, the writing implement holder stem may be physically manipulated to spatially orient the writing implement holder and the writing implement in the desired position for access and retrieval of the writing implement for use.

At block 1010, in some embodiments, the writing implement may be accessed for use by removing the writing implement from the writing implement holder of the assembly. Alternatively, the mounting tab of the assembly may be removed from the crevice for use of the writing implement. After use, at block 1012 the writing implement may be replaced in the writing implement holder or the mounting tab of the writing implement mounting assembly may be again inserted in the crevice. At block 1014, the writing implement mounting assembly with the writing implement may be removed from the crevice.

While the embodiments of the disclosure have been described above, it will be recognized and understood that various modifications can be made and the appended claims are intended to cover all such modifications which may fall within the spirit and scope of the disclosure.

What is claimed is:

1. A writing implement mounting assembly which facilitates removable attachment of a writing implement to an interior of a vehicle in a location or position in which the writing implement is unobtrusive and yet readily accessible and retrievable for use by one or more occupants of the vehicle, comprising:

a mounting tab configured for insertion into a crevice in the interior of the vehicle, the mounting tab having a mounting tab thickness of from about 0.5 mm to about 2.75 mm, the mounting tab having a tab insert end and a tab mount edge opposite the tab insert end, the tab insert end and the tab mount edge extending along a longitudinal mounting tab axis, the mounting tab including:

a tab base having a tab base thickness;

a tab insertion segment, the tab insertion segment having an insertion segment thickness less than the tab base thickness of the tab base, the tab insert end terminating the tab insertion segment;

at least one writing implement carried by the tab base of the mounting tab; and a universally manipulatable writing implement holder stem carried by the tab base of the mounting tab, the at least one writing implement is carried by the writing implement holder stem.

2. A writing implement mounting assembly which facilitates removable attachment of a writing implement to an interior of a vehicle in a location or position in which the writing implement is unobtrusive and yet readily accessible and retrievable for use by one or more occupants of the vehicle, comprising:

a mounting tab configured for insertion into a crevice in the interior of the vehicle, the mounting tab having a mounting tab thickness of from about 0.5 mm to about 2.75 mm, the mounting tab including:

a tab base having a tab base thickness; and a tab insertion segment, the tab insertion segment having an insertion segment thickness less than the tab base thickness of the tab base; and at least one writing implement carried by the tab base of the mounting tab; and a tab middle segment extending from the tab base and wherein the tab insertion segment extends from the tab middle segment, and wherein the tab base comprises a pair of generally planar, parallel, spaced-apart tab base crevice engaging surfaces; the tab middle segment comprises a pair of generally planar, parallel, spaced-apart middle segment crevice engaging surfaces; and the tab insertion segment comprises a pair of generally planar, parallel, spaced-apart insertion segment crevice engaging surfaces.

3. A writing implement mounting assembly, comprising:

a mounting tab including:

a tab base having a tab base thickness, the tab base including a pair of generally planar, parallel, spaced-apart tab base crevice engaging surfaces;

a tab middle segment extending from the tab base, the tab middle segment having a middle segment thickness less than the tab base thickness of the tab base and a pair of generally planar, parallel, spaced-apart middle segment crevice engaging surfaces; and a tab insertion segment extending from the tab middle segment, the tab insertion segment having an insertion segment thickness less than the middle segment thickness of the tab middle segment and a pair of generally planar, parallel, spaced-apart insertion segment crevice engaging surfaces;

at least one writing implement carried by the tab base of the mounting tab; and a pair of beveled tab base transition surfaces extending from the tab base crevice engaging surfaces of the tab base to the middle segment crevice engaging surfaces, respectively, of the tab middle segment and a pair of beveled middle segment transition surfaces extending from the middle segment crevice engaging surfaces of the tab middle segment to the insertion segment crevice engaging surfaces, respectively, of the tab insertion segment.

4. The writing implement mounting assembly of claim 2 wherein the tab base thickness ranges from about 2.25 mm to about 2.75 mm.

5. The writing implement mounting assembly of claim 4 wherein the middle segment thickness is about 0.8 mm.

6. The writing implement mounting assembly of claim 5 wherein the insertion segment thickness is about 0.5 mm.

7. A writing implement mounting assembly, comprising:

a mounting tab including:

a tab base having a tab base thickness, the tab base including a pair of generally planar, parallel, spaced-apart tab base crevice engaging surfaces;

a tab middle segment extending from the tab base, the tab middle segment having a middle segment thickness less than the tab base thickness of the tab base and a pair of generally planar, parallel, spaced-apart middle segment crevice engaging surfaces; and a tab insertion segment extending from the tab middle segment, the tab insertion segment having an insertion segment thickness less than the middle segment thickness of the tab middle segment and a pair of generally planar, parallel, spaced-apart insertion segment crevice engaging surfaces;

wherein the tab base thickness ranges from about 2.25 mm to about 2.75 mm;

wherein the middle segment thickness is about 0.8 mm;

wherein the insertion segment thickness is about 0.5 mm;

at least one writing implement carried by the tab base of the mounting tab; and a pair of beveled tab base transition surfaces extending from the tab base crevice engaging surfaces of the tab base to the middle segment crevice engaging surfaces, respectively, of the tab middle segment and a pair of beveled middle segment transition surfaces extending from the middle segment crevice engaging surfaces of the tab middle segment to the insertion segment crevice engaging surfaces, respectively, of the tab insertion segment.

8. The writing implement mounting assembly of claim 7 further comprising at least one writing implement holder carried by the tab base of the mounting tab, and wherein the at least one writing implement is carried by the writing implement holder.

* * * * *